US008309506B2

(12) United States Patent
Sunder et al.

(10) Patent No.: US 8,309,506 B2
(45) Date of Patent: Nov. 13, 2012

(54) WASHING AID HAVING AN ANTIBACTERIAL EFFECT

(75) Inventors: Matthias Sunder, Dusseldorf (DE); Robert Stephen Cappleman, Duisburg (DE); Francesca Corbellini, Cologne (DE); Georg Meine, Mettmann (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/232,551

(22) Filed: Sep. 14, 2011

(65) Prior Publication Data

US 2012/0003289 A1 Jan. 5, 2012

Related U.S. Application Data

(63) Continuation of application No. PCT/EP2010/053017, filed on Mar. 10, 2010.

(30) Foreign Application Priority Data

Mar. 20, 2009 (DE) ..... 10 2009 001 686

(51) Int. Cl.
*C11D 3/48* (2006.01)
*C11D 3/395* (2006.01)
*C11D 1/04* (2006.01)

(52) U.S. Cl. ..... 510/295; 510/302; 510/353; 510/367; 510/372; 510/375; 510/437; 510/491; 510/508

(58) Field of Classification Search ..... 510/295, 510/302, 353, 367, 372, 375, 437, 491, 508
See application file for complete search history.

(56) References Cited

U.S. PATENT DOCUMENTS

| | | | | |
|---|---|---|---|---|
| 5,288,746 | A * | 2/1994 | Pramod | 510/321 |
| 6,214,777 | B1 * | 4/2001 | Li et al. | 508/388 |
| 7,012,053 | B1 * | 3/2006 | Barnabas et al. | 510/287 |
| 2006/0034798 | A1 * | 2/2006 | Mosbey et al. | 424/78.38 |
| 2006/0198876 | A1 | 9/2006 | Tichy et al. | |
| 2010/0160201 | A1 * | 6/2010 | Scheuing et al. | 510/180 |

FOREIGN PATENT DOCUMENTS

| | | | |
|---|---|---|---|
| WO | WO 96/18301 | A1 | 6/1996 |
| WO | WO 2004/083352 | A1 | 9/2004 |

OTHER PUBLICATIONS

PCT International Search Report (PCT/EP2010/053017) dated Oct. 5, 2010.

Kanicky et al, "Cooperativity among Molecules at Interfaces in Relation to Various Technological Processes . . . ", Langmuir 2000, vol. 16, pp. 172-177.

* cited by examiner

*Primary Examiner* — Charles Boyer
(74) *Attorney, Agent, or Firm* — David K. Benson

(57) ABSTRACT

The present invention is an auxiliary washing aid comprising a textile substrate coated or otherwise impregnated with a composition comprising elementary silver and/or a silver compound, non-neutralized fatty acid, and hydrogen peroxide.

11 Claims, No Drawings

WASHING AID HAVING AN ANTIBACTERIAL EFFECT

CROSS-REFERENCES TO RELATED APPLICATIONS

This application is a continuation of PCT/EP2010/053017, filed on Mar. 10, 2010, which claims priority under 35 U.S.C. §119 to DE 10 2009 001 686.4 filed on Mar. 20, 2009. The disclosures PCT/EP2010/053017 and DE 10 2009 001 686.4 are hereby incorporated by reference in their entirety.

FIELD OF THE INVENTION

The present invention generally relates to an auxiliary washing aid having an antibacterial effect and more particularly relates to a textile substrate impregnated or coated with a composition having an antibacterial effect. The invention also relates to the use of, as well as a process for manufacturing, an auxiliary washing aid.

BACKGROUND OF THE INVENTION

The adherence of microorganisms on surfaces is unwanted, particularly in the case of pathogenic microorganisms. Adhering microorganisms frequently lead to infections or to reinfections in humans, animals, and plants.

Moreover, delicate textiles, such as silk microfibers, are more frequently used in clothing, and may be washed only at 30 or 40° C. Consequently, fungi, such as the human pathogen *Candida albicans*, are not destroyed during the washing procedure.

In addition to the lower washing temperatures, liquid washing agents generally free of bleaching agents are also commonly used. For 60° C. washing conditions, as was previously considered typical, nearly all germs were reliably killed off, firstly by the higher temperature, secondly by the bleaching agent typically found in washing agents.

As a consequence of the modified washing conditions more commonly found today, textiles contaminated with viruses, bacteria, mold fungi or yeast fungi cannot be made germ-free to the point where re-infection of the consumer from renewed contact of the with the supposedly clean laundry is prevented.

In addition, problems with bad odors can occur because residual germs proliferate on the washing in the course of drying, wearing or storing and produce malodorous metabolites. Moreover, biofilms that adhere to the interior of a washing machine can cause unpleasant odors.

Antimicrobially active compositions and their use in washing, cleaning, after treatment or auxiliary washing agents are known from the prior art. The added disinfectants frequently involve halogen-containing substances or phenol derivatives or other aromatic hydrocarbons that may be a problem for environmental sustainability. Other more compatible microbiocides have only a limited activity spectrum, or are only effective under certain physical conditions. For domestic applications, however, there is a great need for antimicrobial compositions effective against a broad spectrum of microorganisms and are environmentally friendly and preferably of natural origin.

Silver or silver ions possess antimicrobial efficacy and perform, inter alia, blocking of thiol enzymes in microorganisms resulting in high bactericidal, germicidal, and fungicidal action. Germ-reducing washing, cleaning, after treatment, and auxiliary washing agents comprising silver and/or silver ions are known in the prior art, for example as disclosed in EP 1 670 885 A1.

However, compositions that comprise silver and/or silver ions are often unstable since the silver ions comprised in the agents can react with impurities such as chloride ions to form light-sensitive silver chloride salts or with sulfide to form poorly soluble silver sulfide salts. In a (strongly) alkaline medium, soluble silver ions initially react to form AgOH and then react further to form sparingly soluble $Ag_2O$. In addition to the poor solubility of these silver salts, the silver oxides and silver sulfides, in spite of their trace quantities, lead to considerable color changes, in particular a brown or black coloration, of the composition.

Accordingly, it is desirable to provide a stable, antibacterial auxiliary washing agent based on silver or silver ions.

SUMMARY OF THE INVENTION

It has now been discovered that a stable antibacterial auxiliary washing aid is possible when the agent comprises a textile substrate coated or impregnated with a composition comprising:

(a) elemental silver and/or a silver compound;
(b) non-neutralized fatty acid; and
(c) hydrogen peroxide.

It has been surprisingly found that the elemental silver and/or the silver cation of the silver compound can be stabilized by the presence of the non-neutralized fatty acid and hydrogen peroxide, without the occurrence of a reduction in the germicidal activity of the auxiliary washing agent

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

This goal of the invention is achieved through an auxiliary washing agent, comprising a textile substrate that is coated or impregnated with a composition, wherein the composition comprises:

(a) elemental silver and/or a silver compound;
(b) non-neutralized fatty acid; and
(c) hydrogen peroxide.

The separate metering of an antibacterial compound from an auxiliary textile substrate has the advantage that the consumer can decide which laundry articles require additional antibacterial treatment. Furthermore, the consumer does not need to deviate from normal laundry habits, such as the choice of washing agent, and merely adds the auxiliary washing agent having an antibacterial effect when deemed necessary.

The elemental silver and/or the silver cation of the silver compound is stabilized by the presence of the non-neutralized fatty acid and hydrogen peroxide, without the occurrence of a reduction in the germicidal activity of the auxiliary washing agent.

In a preferred embodiment, the composition of the auxiliary washing agent further comprises an auxiliary washing agent compound selected from the group consisting of surfactants, enzymes, perfumes, fluorescent agents, soil release-polymers, anti-graying inhibitors, shrink preventers, anti-crease agents, color transfer inhibitors, additional antimicrobials, germicides, fungicides, antioxidants, antistats, ironing aids, softening components, non-ionic fabric softeners, UV absorbers, and mixtures thereof.

By adding one or more auxiliary washing agent compound (s), the auxiliary washing agent can be complemented with additional functionalities such as an increased cleaning power or the provision of fabric care properties. Consequently, with only one auxiliary washing agent the consumer can bestow on the fabrics being washed several properties such as for example cleanliness, freshness, color intensity, dirt repellency, etc.

The silver compound is preferably selected from the group consisting of silver acetate, silver citrate, silverdiamine chloride complex, silver cyclodextrin complex, silver dicyanopotassium complex, silver phthalimide, silver phenylcyanamide, silver (ethylenethiourea) complex, silver imidazolate, transition metal-NHC-calix[4]arene complexes, silver crown ethers, silver nitrate, silver chloride on a carrier material, and mixtures thereof. The auxiliary washing agent particularly preferably comprises silver nitrate.

With the exception of the silver chloride on a carrier material, the cited silver compounds have a sufficiently high solubility and do not precipitate out of the auxiliary washing agent compositions.

Alternatively, a silver compound that is deposited onto a carrier material can also be employed as the silver compound. Silver chloride for example that is deposited on titanium dioxide is particularly suitable. These silver compounds can be employed in the present invention in the form of aqueous dispersions or powders, for example as supplied by Clariant under the name JMAC. In particular, these powders have the advantage that they are easier to handle and easily metered.

It is preferred that the quantity of elemental silver and/or of silver compound is from 0.0001 to 1 wt. %, based on the total composition of the auxiliary washing agent.

It is particularly preferred that the ratio of non-neutralized fatty acid to elemental silver and/or silver cations in the silver compound is greater than or equal to 8 to 1. By adjusting to this ratio a particularly effective stabilization of the silver or silver cation of the silver compound is achieved.

It is also preferable that the quantity of non-neutralized fatty acid be between 0.01 and 10 wt. %, based on the total composition of the auxiliary washing agent. With this amount of non-neutralized fatty acid an effective stabilization of the silver or silver cation of the silver compound is achieved. Too large an amount of non-neutralized fatty acid leads to inhomogeneity and/or to unwanted cloudiness of the auxiliary washing agent, due to incomplete dissolution of the non-neutralized fatty acid in the composition. The inhomogeneities and/or cloudiness are often perceived by the consumer as defective batches that can lead to a lower consumer acceptance of the product.

Optionally, the auxiliary washing agent may additionally comprise from 0.01 to 3 wt. % ammonium hydroxide, based on the total composition of the auxiliary washing agent. Surprisingly, it has been found that clear and esthetically appealing compositions are possible by adding low amounts of ammonium hydroxide.

Preferred auxiliary washing agents comprise the neutralized and the non-neutralized form of a fatty acid. A stable fatty acid soap-containing and silver-containing auxiliary washing agent can be simply and quickly manufactured with the help of the pH of the composition of the auxiliary washing agent or by adding a pH adjustor. In this embodiment of the invention, the fatty acid soap can also function as the auxiliary washing agent compound.

It is further preferred that the composition of the auxiliary washing agent comprise surfactants, color transfer inhibitors, and mixtures thereof, as the auxiliary washing agent compound. In this regard it is particularly preferred that the composition of the auxiliary washing agent contain surfactants, and in particular a mixture of a non-ionic surfactant and an amine oxide. This surfactant combination leads to an improved cleaning power, particularly for oil-based soils.

Color transfer inhibitors often undergo unwanted reactions with other ingredients of washing agents, such that it is advantageous to also meter them separately through the auxiliary washing agent. For washing and cleaning fabrics, an improved cleaning power can be achieved by adding additional surfactants, in particular by adding amine oxides.

The invention also relates to the use of an inventive auxiliary washing agent for washing and/or cleaning fabrics.

Further, the invention also relates to a process for manufacturing an auxiliary washing agent, comprising a textile substrate and an antibacterially active composition, wherein a textile substrate is coated with a composition that comprises silver and/or a silver compound as the antibacterial component, a non-neutralized fatty acid and hydrogen peroxide, or wherein the textile substrate is impregnated with a composition that comprises silver and/or a silver compound as the antibacterial component, a non-neutralized fatty acid and hydrogen peroxide.

The invention also relates to the use of hydrogen peroxide and non-neutralized fatty acid for stabilizing a composition that comprises silver and/or a silver compound as the antibacterial component and is located on a textile substrate or with which a textile substrate is impregnated.

The invention is described below in more detail inter alia by means of examples.

The auxiliary washing agent is comprised of a textile substrate and an antimicrobially active composition, wherein the composition is either provided on the textile substrate or the textile substrate is impregnated with the composition.

The composition comprises elemental silver and/or a silver compound as an essential ingredient.

Silver is inventively added in elemental form or in the form of its compounds. If the silver is added in elemental form then its particle size is preferably between 1 nm and 100 μm. Even finer particle sizes of the silver can be achieved by adding the elemental silver in colloidal form, wherein the particle size of the silver is between 0.001 to 0.1 μm.

It is preferred that the agent comprises a silver compound selected from the group consisting of silver acetate, silver citrate, silverdiamine chloride complex, silver cyclodextrin complex, silver dicyanopotassium complex, silver phthalimide, silver phenylcyanamide, silver (ethylenethiourea) complex, silver imidazolate, transition metal-NHC-calix[4]arene complexes, silver crown ethers, silver nitrate, silver chloride on a carrier material, and mixtures thereof. The silver compounds are preferably added in the form of powders, solutions, suspensions, or dispersions. The washing, cleaning, post-treatment or auxiliary washing agent particularly preferably comprises silver nitrate that is added in the form of an aqueous solution, or silver chloride on titanium dioxide carrier material, which is added as a powder or aqueous dispersion.

The quantity of elemental silver and/or of silver compound is preferably 0.0001 to 1 wt. % and more preferably between 0.001 and 0.25 wt. %, based on the total composition of the auxiliary washing agent. Quite particularly preferred auxiliary washing agents comprise 0.01 to 0.1 wt. % of elemental silver and/or of silver compound, based on the total composition of the auxiliary washing agent.

The composition of the auxiliary washing agent comprises a non-neutralized fatty acid as a further essential ingredient.

The amount of non-neutralized fatty acid in the composition of the auxiliary washing agent also depends on the amount of added silver or added silver compound. In general, the amount of non-neutralized fatty acid is in the range 0.01% to 10%, preferably 0.1% to 8% and more strongly preferably 0.5 to 5%, for an optimal stabilization at minimal cost.

In this regard it is further preferred that the ratio of non-neutralized fatty acid to elemental silver and/or the quantity of silver cations from the silver compound is greater than or equal to 8 to 1. A particularly effective stabilization of the silver and/or silver compound is achieved when the non-neutralized fatty acid is added in this relative excess.

Suitable fatty acids include caprylic acid, capric acid, lauric acid, myristic acid, palmitic acid, stearic acid, (hydrogenated) eucic acid, linoleic acid, linolenic acid, oleic acid, behenic acid, dimer fatty acids, as well as the naturally occurring fatty acids such as coco, palm nut, olive oil, or tallow fatty acids.

The content of non-neutralized fatty acid in the composition can be determined or adjusted either experimentally (for example by titration) or by knowing the pKa of the added fatty acid and the pH of the composition with the aid of the Henderson-Hasselbach equation.

The pH of the composition of the auxiliary washing agent is adjusted such that pH also contributes to hydrogen peroxide stabilization. The pH of the composition is preferably around 6.8±0.2. For reasons of stability, it is particularly preferred that the pH of the composition does not exceed 7.0.

The composition comprises hydrogen peroxide as the third essential constituent. The amount of hydrogen peroxide is preferably between 0.01 and 5 wt. % and quite particularly preferably between 0.1 and 2.5 wt. %.

The composition of the auxiliary washing agent preferably comprises at least one auxiliary washing agent compound. This includes for example surfactants, enzymes, perfumes, fluorescent agents, soil release-polymers, anti-graying inhibitors, shrink preventers, anti-crease agents, color transfer inhibitors, additional antimicrobials, germicides, fungicides, antioxidants, antistats, ironing aids, softening components, non-ionic fabric softeners, UV absorbers, and mixtures thereof.

A surfactant, a mixture of surfactants, a color transfer inhibitor, a mixture of a surfactant and a color transfer inhibitor or a mixture of a plurality of surfactants and a color transfer inhibitor is preferably added as the auxiliary washing agent compound.

If the composition of the auxiliary washing agent comprises a mixture of a plurality of surfactants as the auxiliary washing agent compound, then the mixture preferably contains both a non-ionic surfactant and an amine oxide.

Suitable non-ionic surfactants include alkoxylated fatty alcohols, alkoxylated fatty acid alkyl esters, fatty acid amides, alkoxylated fatty acid amides, polyhydroxyfatty acid amides, alkylphenol polyglycol ethers, and mixtures thereof.

Preferred non-ionic surfactants are alkoxylated, advantageously ethoxylated, and are particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain e.g. linear and methyl-branched groups in the form of the mixtures typically present in oxo alcohol groups. In particular, however, alcohol ethoxylates with linear alcohol groups of natural origin with 12 to 18 carbon atoms, e.g. from coco-, palm-, tallow- or oleyl alcohol, and an average of 2 to 8 EO per mole alcohol are preferred. Exemplary preferred ethoxylated alcohols include $C_{12-14}$ alcohols with 3 EO or 4 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are tallow fatty alcohol with 14 EO, 25 EO, 30 EO or 40 EO. Also, non-ionic surfactants that comprise the EO and PO groups together in the molecule are employable according to the invention. The cleaning agent for hard surfaces particularly preferably comprises a $C_{12-18}$ fatty alcohol with 7 EO or a $C_{13-15}$ oxoalcohol with 7 EO as the non-ionic surfactant.

The content of non-ionic surfactants in the composition is preferably 1 to 30 wt. % and advantageously 2 to 25 wt. %, each based on the total composition of the auxiliary washing agent.

Suitable amine oxides include for example alkylamine oxides, particularly the alkyldimethylamine oxides, alkylamido amine oxides, and alkoxyalkylamine oxides.

Exemplary suitable amine oxides are the following compounds named according to INCI: Almondamidopropylamine Oxide, Babassuamidopropylamine Oxide, Behenamine Oxide, Cocamidopropyl Amine Oxide, Cocamidopropylamine Oxide, Cocamine Oxide, Coco-Morpholine Oxide, Decylamine Oxide, Decyltetradecylamine Oxide, Diaminopyrimidine Oxide, Dihydroxyethyl $C_8$-$C_{10}$ Alkoxypropylamine Oxide, Dihydroxyethyl $C_9$-$C_{11}$ Alkoxypropylamine Oxide, Dihydroxyethyl $C_{12}$-$C_{15}$ Alkoxypropylamine Oxide, Dihydroxyethyl Cocamine Oxide, Dihydroxyethyl Lauramine Oxide, Dihydroxyethyl Stearamine Oxide, Dihydroxyethyl Tallowamine Oxide, Hydrogenated Palm Kernel Amine Oxide, Hydrogenated Tallowamine Oxide, Hydroxyethyl Hydroxypropyl $C_{12}$-$C_{15}$ Alkoxypropylamine Oxide, Isostearamidopropylamine Oxide, Isostearamidopropyl Morpholine Oxide, Lauramidopropylamine Oxide, Lauramine Oxide, Methyl Morpholine Oxide, Milkamidopropyl Amine Oxide, Minkamidopropylamine Oxide, Myristamidopropylamine Oxide, Myristamine Oxide, Myristyl/Cetyl Amine Oxide, Oleamidopropylamine Oxide, Oleamine Oxide, Olivamidopropylamine Oxide, Palmitamidopropylamine Oxide, Palmitamine Oxide, PEG-3 Lauramine Oxide, Potassium Dihydroxyethyl Cocamine Oxide Phosphate, Potassium Trisphosphonomethylamine Oxide, Sesamidopropylamine Oxide, Soyamidopropylamine Oxide, Stearamidopropylamine Oxide, Stearamine Oxide, Tallowamidopropylamine Oxide, Tallowamine Oxide, Undecylenamidopropylamine Oxide, and Wheat Germamidopropylamine Oxide. Preferred exemplary amine oxides are N-cocoalkyl-N,N-dimethylamine oxide, N-tallowalkyl-N,N-dihydroxyethylamine oxide, myristylcetyldimethylamine oxide, and lauryldimethylamine oxide.

The content of amine oxide in the composition is preferably 1 to 15 wt. % and advantageously 2 to 10 wt. %, each based on the total composition of the auxiliary washing agent.

Another preferred auxiliary washing agent compound is a color transfer inhibitor. The color transfer inhibitor is preferably a polymer or copolymer of cyclic amines such as for example vinyl pyrrolidone and/or vinylimidazole. As color transfer inhibitors, suitable polymers include polyvinyl pyrrolidone (PVP), polyvinylimidazole (PVI), copolymers of vinyl pyrrolidone and vinylimidazole (PVP/PVI), polyvinylpyridine-N-oxide, poly-N-carboxymethyl-4-vinylpyridium chloride, polyethyleneimine (PEI) as well as mixtures of them. Polyvinyl pyrrolidone (PVP), polyvinylimidazole (PVI) or copolymers of vinyl pyrrolidone and vinylimidazole (PVP/PVI) are particularly preferably employed as color transfer inhibitors.

The amount of color transfer inhibitor based on the total weight of the composition of the auxiliary washing agent is preferably 0.01 to 2 wt. %, advantageously from 0.05 to 1 wt. % and more preferably from 0.1 to 0.5 wt. %.

Another preferred auxiliary washing agent compound is a perfume, wherein the ingredients of the perfume, especially the fragrances, are advantageously compatible with the silver and/or silver compound.

Alternatively to or in addition to the non-ionic surfactant (s), the composition of the auxiliary washing agent can also comprise an anionic surfactant as the auxiliary washing agent compound. Sulfonates, sulfates, soaps and mixtures thereof are preferably employed as the anionic surfactant.

Suitable surfactants of the sulfonate type are, advantageously $C_{9-13}$ alkylbenzene sulfonates, olefin sulfonates, i.e. mixtures of alkene- and hydroxyalkane sulfonates and disulfonates, as are obtained, for example, from $C_{12-18}$ monoolefins having a terminal or internal double bond, by sulfonation with gaseous sulfur trioxide and subsequent alkaline or acidic hydrolysis of the sulfonation products.

$C_{12-18}$ alkane sulfonates and the esters of α-sulfofatty acids (ester sulfonates), e.g. the α-sulfonated methyl esters of hydrogenated coco-, palm nut- or tallow acids are likewise suitable.

Preferred alk(en)yl sulfates are the alkali metal and especially sodium salts of the sulfuric acid half-esters derived from the $C_{12}$-$C_{18}$ fatty alcohols, for example from coconut butter alcohol, tallow alcohol, lauryl, myristyl, cetyl or stearyl alcohol or from $C_{10}$-$C_{20}$ oxo alcohols and those half-esters of secondary alcohols of these chain lengths. The $C_{12}$-$C_{16}$ alkyl sulfates and $C_{12}$-$C_{15}$ alkyl sulfates and $_{C14}$-$C_{15}$ alkyl sulfates are preferred on the grounds of washing performance. 2,3-Alkyl sulfates are also suitable anionic surfactants.

Sulfuric acid mono-esters derived from straight-chained or branched $C_{7-21}$ alcohols ethoxylated with 1 to 6 moles ethylene oxide are also suitable, for example 2-methyl-branched alcohols with an average of 3.5 mole ethylene oxide (EO) or $C_{12-18}$ fatty alcohols with 1 to 4 EO.

Soaps are also preferred anionic surfactants. Saturated and unsaturated fatty acid soaps are suitable, such as the salts of lauric acid, myristic acid, palmitic acid, stearic acid, (hydrogenated) erucic acid and behenic acid, and especially soap mixtures derived from natural fatty acids such as coconut oil fatty acid, palm kernel oil fatty acid, olive oil fatty acid or tallow fatty acid.

The anionic surfactants, including the soaps, can be present in the form of their sodium, potassium or magnesium or ammonium salts. The anionic surfactants are preferably present in the form of their sodium salts. Other preferred counter ions besides sodium for the anionic surfactants include the protonated forms of choline, triethylamine and methylethylamine.

It is also preferred that the composition of the auxiliary washing agent comprise the neutralized and the non-neutralized form of a fatty acid. This is advantageous, in particular for fatty acid soap-containing compositions, because the pH can be quite easily adjusted, for example by adding pH adjustors, to the amount of non-neutralized fatty acid needed for stabilizing the silver or the silver cation.

Alternatively, the fatty acid soap can be derived from another fatty acid than that added for stabilizing the elemental silver and/or the silver cation.

In order to bring the pH of the composition of auxiliary washing agent into the desired range, pH adjustors can be added. Here, any known acid or alkali can be added. Sodium hydroxide (NaOH) or citric acid is the preferred pH adjustor.

The composition of the auxiliary washing agent is manufactured by means of usual and known methods and processes. Thus for example the ingredients can be simply blended in stirred vessels, wherein water, the acidic components, when present, such as for example the citric acid, and the non-ionic surfactants are expediently provided. The non-neutralized fatty acid is then added and then the further ingredients, including the hydrogen peroxide, are then added, preferably in portions.

If the composition also comprises neutralized fatty acid then after adding the surfactants it is advantageous to provide a base (including ammonium hydroxide, when present), to add the non-neutralized fatty acid and then to saponify a part of the non-neutralized fatty acid at 50 to 60° C. The further ingredients, including the hydrogen peroxide, are then added, preferably in portions.

In both cases the elemental silver or the silver compound is added in the last step. Prior to adding the silver or the silver compound the pH is checked and when needed adjusted to a value of 6.8±0.2 by adding a pH adjustor.

Once the composition has been manufactured it is deposited onto a textile substrate or a textile substrate is impregnated with the composition. The textile substrate preferably consists of a porous, flat cloth. The cloth can consist of a fibrous or cellular flexible material. Preferably, typical cloths of non-woven material (fleece) are used. Fleeces are generally defined as adhesively bonded fibrous products that possess a matted or layered fiber structure, or those that include fiber mats, in which the fibers are distributed randomly or statistically. The fibers can be natural, such as wool, silk, jute, cotton, linen, sisal or ramie; or synthetic, such as rayon, cellulose esters, polyvinyl derivatives, polyolefins, polyamides or polyester. Preferred porous and flat cleaning cloths consist of one or various fiber materials, particularly of cotton, refined cotton, polyamide, polyester or mixtures of these.

The dimensions of the textile substrate (i.e. the fabric) should allow easy manageability of the auxiliary washing agent and should, for example, measure 10 cm×10 cm or 20 cm×20 cm, although other sizes are also usable. The textile substrate and thereby the auxiliary washing agent can be of any flat shape, for example quadratic, rectangular, triangular, round, oval, heart-shaped, in the form of letters or words or correspond to the reproduction of a trade mark. The textile substrate can be of any color or be essentially white; its surface can be essentially smooth or textured in the course of manufacture. In a preferred embodiment of the invention, the textile substrate is charged, at least on parts of its surface, with a color catcher, such that in the inventive auxiliary washing agent the color catcher is located under or, if the antibacterial composition does not cover the whole surface area, beside the zone with the antibacterial composition.

As color catchers, suitable polymers include polyvinyl pyrrolidone (PVP), polyvinylimidazole (PVI), copolymers of vinyl pyrrolidone and vinylimidazole (PVP/PVI), polyvinylpyridine-N-oxide, poly-N-carboxymethyl-4-vinylpyridium chloride, polyethyleneimine (PEI) as well as mixtures of them. Alternatively, the material of the textile substrate can itself possess color catching properties. In this embodiment, the textile substrate is made of polyamide for example.

EXAMPLES

TABLE 1 delineates the compositions of two comparative formulations V1 and V2 along with the compositions of three inventive washing or cleaning agents E1 to E3 (all quantities are given in wt. % active substance, based on the composition).

TABLE 1

Comparative and Inventive Washing or Cleaning Agents

| | V1 | E1 | V2 | E2 | E3 |
|---|---|---|---|---|---|
| $C_{12-18}$ fatty alcohol/7 EO | 12 | 12 | 12 | 12 | 12 |
| Cocodimethylamine oxide | 2 | 2 | 2 | 2 | 2 |
| $AgNO_3 \cdot H_2O$ | 0.0136 | 0.0136 | 0.0136 | 0.0136 | 0.0136 |
| $C_{14}$ fatty acid | 5 | 5 | — | — | — |
| Coco fatty acid | — | — | 5 | 5 | 5 |
| Citric acid | 2.6 | 2.6 | 2.6 | 2.7 | 2.7 |
| $H_2O_2$ | — | 0.35 | | 0.35 | 0.35 |
| NaOH | 1.8 | 1.8 | 1.9 | 1.9 | 1.9 |
| $NH_4OH$ | 0.1 | 0.1 | 0.1 | 0.1 | 0.1 |
| Color transfer inhibitor* | — | — | — | — | 0.3 |
| Water | q.s. | q.s. | q.s. | q.s. | q.s. |
| pH | 7.0 | 7.0 | 7.0 | 7.0 | 7.0 |

*PVP/PVI Polymer (Sokalan ® 56 from BASF)

For each of the compositions of the auxiliary washing agents E1 and V2 the amount of non-neutralized fatty acid was 4.67 wt. %. The content of non-neutralized fatty acid was measured by using the Henderson-Hasselbalch equation, applying a pKa of 8.15 for myristic acid (J. R. Kanicky, A. F. Poniatowski, N. R. Mehta and D. Shah, Langmuir, vol. 16, pp. 172-177, 2000).

10 g of the compositions V1 and V2 as well as E1 to E3 were each deposited on a fleece (HDK 401 sourced from HDK Industries Inc., Rogersville, Tenn.) with a size of 177× 190 mm. The cloths, even after drying the composition on the textile substrate, remained highly flexible.

For the auxiliary washing agents with the compositions V1 and V2, significant gray-black colorations appeared even after a few hours, whereas those using the auxiliary washing agents comprising compositions E1 to E3 showed no coloration at all even after extended storage.

In order to detect and determine the antimicrobial power of the auxiliary washing agent a first laundry batch was washed with a liquid universal washing agent and a second laundry batch was washed with the same liquid washing agent together with the auxiliary washing agent E2. The damp washing was left 6 hours in the washing machine at the end of the respective wash cycle and then subjected to an odor assessment by a trained test person.

The odor of the second laundry batch that had been treated with the auxiliary washing agent E2 was assessed as "fresh", whereas the first laundry batch smelled more "fusty".

This test clearly shows that the inventive auxiliary washing agents have an antibacterial action and for example the appearance of unpleasant odors, caused by bacteria, when storing damp washing can be suppressed or reduced.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

We claim:

1. An auxiliary washing agent comprising:

a. a textile substrate; and b. a dry composition, coated on or impregnated in said substrate, comprising:

i. elemental silver and/or a silver compound;

ii. non-neutralized fatty acid; and iii. hydrogen peroxide.

2. The auxiliary washing agent of claim 1, wherein said composition further comprises an auxiliary washing agent compound selected from the group consisting of surfactants, enzymes, perfumes, fluorescent agents, soil release-polymers, anti-graying inhibitors, shrink preventers, anti-crease agents, color transfer inhibitors, additional antimicrobials, germicides, fungicides, antioxidants, antistats, ironing aids, softening components, non-ionic fabric softeners, UV absorbers, and mixtures thereof.

3. The auxiliary washing agent of claim 1, wherein said silver compound is selected from the group consisting of silver acetate, silver citrate, silverdiamine chloride complex, silver cyclodextrin complex, silver dicyanopotassium complex, silver phthalimide, silver phenylcyanamide, silver (ethylenethiourea) complex, silver imidazolate, transition metal-NHC-calix[4] arene complexes, silver crown ethers, silver nitrate, silver chloride on a carrier material, and mixtures thereof.

4. The auxiliary washing agent of claim 1, wherein the quantity of said elemental silver and/or of silver compound is 0.0001 to 1 wt. %, based on the total composition of the auxiliary washing agent.

5. The auxiliary washing agent auxiliary washing agent of claim 1, wherein the ratio of non-neutralized fatty acid to elemental silver and/or the quantity of silver cations in the silver compound is greater than or equal to 8 to 1.

6. The auxiliary washing agent auxiliary washing agent of claim 1, wherein the quantity of non-neutralized fatty acid is between 0.01 and 10 wt. %, based on the total composition of the auxiliary washing agent.

7. The auxiliary washing agent auxiliary washing agent of claim 1, wherein said composition further comprises 0.01 to 3 wt. % ammonium hydroxide, based on the total composition of the auxiliary washing agent.

8. The auxiliary washing agent of claim 1, wherein said composition further comprises a neutralized fatty acid.

9. The auxiliary washing agent of claim 2, wherein the auxiliary washing agent compound is selected from the group consisting of surfactants, color transfer inhibitors, and mixtures thereof.

10. The auxiliary washing agent of claim 9, wherein said surfactants comprise a mixture of a non-ionic surfactant and an amine oxide.

11. A process for manufacturing of the auxiliary washing agent of claim 1, comprising the steps of: (1) coating or impregnating said textile substrate with a composition comprising silver and/or a silver compound, a non-neutralized fatty acid, and hydrogen peroxide; and (2) drying said composition thereon or therein.

* * * * *